US007907115B2

(12) United States Patent
Zheng et al.

(10) Patent No.: US 7,907,115 B2
(45) Date of Patent: Mar. 15, 2011

(54) DIGITALLY SYNCHRONIZED INTEGRATOR FOR NOISE REJECTION IN SYSTEM USING PWM DIMMING SIGNALS TO CONTROL BRIGHTNESS OF COLD CATHODE FLUORESCENT LAMP FOR BACKLIGHTING LIQUID CRYSTAL DISPLAY

(75) Inventors: Dong Zheng, San Jose, CA (US); Robert L. Lyle, Jr., Raleigh, NC (US); Barry Harvey, Los Altos, CA (US); Brian V. North, Los Gatos, CA (US)

(73) Assignee: Intersil Americas Inc., Milpitas, CA (US)

( * ) Notice: Subject to any disclaimer, the term of this patent is extended or adjusted under 35 U.S.C. 154(b) by 74 days.

(21) Appl. No.: 12/409,238

(22) Filed: Mar. 23, 2009

(65) Prior Publication Data

US 2009/0179583 A1 Jul. 16, 2009

Related U.S. Application Data

(62) Division of application No. 11/237,075, filed on Sep. 28, 2005, now Pat. No. 7,528,818.

(60) Provisional application No. 60/675,273, filed on Apr. 27, 2005.

(51) Int. Cl.
*G09G 3/36* (2006.01)

(52) U.S. Cl. ..... 345/102; 345/212; 345/204; 345/99; 345/76

(58) Field of Classification Search ..... 345/99, 345/98, 94, 100, 102, 76, 207, 204, 212, 345/211, 213; 315/247, 246, 291, 307–311
See application file for complete search history.

(56) References Cited

U.S. PATENT DOCUMENTS 6,850,015 B2 2/2005 Ishizuka et al.
7,507,943 B2 * 3/2009 Ichikawa et al. ..... 250/205

* cited by examiner

*Primary Examiner* — Tuyet Thi Vo
(74) *Attorney, Agent, or Firm* — Fogg & Powers LLC

(57) ABSTRACT

An apparatus and method for controlling the operation of a utility device, such as a cold cathode fluorescent lamp that is powered in accordance with a pulse width modulation (PWM) signal, includes an analog sensor which monitors the utility device to derive an output signal representative of the PWM signal. An integrating analog-to-digital converter (ADC), which is coupled to the sensor and has its operation synchronized with an integral multiple of the period of the PWM signal, produces an output representative of an average of the output of the utility device.

8 Claims, 4 Drawing Sheets

DIGITALLY SYNCHRONIZED INTEGRATOR FOR NOISE REJECTION IN SYSTEM USING PWM DIMMING SIGNALS TO CONTROL BRIGHTNESS OF COLD CATHODE FLUORESCENT LAMP FOR BACKLIGHTING LIQUID CRYSTAL DISPLAY

CROSS-REFERENCE TO RELATED APPLICATION

The present application is a divisional application of U.S. application Ser. No. 11/237,075 (the '075 Application), filed Sep. 28, 2005 (pending). This application also claims the benefit of U.S. Provisional Application Ser. No. 60/675,273 (the '273 Application), filed Apr. 27, 2005. The '075 Application and the '273 Application are incorporated herein by reference.

FIELD OF THE INVENTION

The present invention relates in general to power supply systems and subsystems thereof, and is particularly directed to a circuit and methodology for digitally synchronizing the integration period of an analog-to-digital converter (ADC) with integral multiples of the period of a periodically varying analog input signal so as to prevent variations in the output of the ADC. The present invention has particular utility in system for powering a cold cathode fluorescent lamp (CCFL) of the type employed for backlighting a liquid crystal display, wherein the duty cycle of a pulse width modulation (PWM) signal is used to controllably dim (control the brightness of) the CCFL.

BACKGROUND OF THE INVENTION

There are a variety of electrical systems which require one or more sources of power for controlling the operation of a system application device. As a non-limiting example, a liquid crystal display (LCD), such as that employed in desktop and laptop computers, or in larger display applications such as large scale television screens, requires an associated set of high AC voltage-driven cold cathode fluorescent lamps (CCFLs) or other light sources mounted directly behind it for backlighting purposes. Indeed, large LCD panels require relatively large numbers (e.g., on the order of ten to forty) of such lamps for uniform backlighting.

Adjusting the brightness (or dimming) of a CCFL is customarily effected by means of a pulse width modulation (PWM) dimming signal, which controllably switches the lamp drive voltage and current off for brief periods of time; namely, the CCFL is turned ON and OFF for relatively short periods of time (e.g., from 0.1 to 5 msec. each), with the brightness of the lamp being proportional to the PWM signal's duty cycle. This methodology may be carried out by applying a separate PWM dimming signal to each inverter.

In order to properly establish the duty cycle of the PWM dimming signal, the optical output of the CCFL is monitored to measure the average brightness of the lamp over a plurality of cycles of the PWM signal. For this purpose, an analog light sensor is optically coupled to sense the light output of the CCFL, and the output of the light sensor, the amplitude of which varies in accordance with the PWM signal being applied to the CCFL, is subjected to an integration process which yields an output that ostensibly represents the average brightness of the lamp. Where the light sensor PWM output signal is converted into digital format for downstream processing, it is necessary that the digitization process be conducted over a plurality of cycles of the optical detector's output signal in order to realize an 'average' of the brightness of the lamp. An undesirable 'flickering' problem may occur if the integration period of the analog-to-digital conversion is selected arbitrarily, with no consideration being given to whether or not the integration period is synchronized with a prescribed multiple of the period of the PWM signal produced by the optical sensor.

This problem may be readily understood by reference to the waveform diagram of FIG. 1, which shows a fixed duty cycle PWM 'input' signal 100, as may be produced from the output of an optical sensor monitoring the modulation of the light output of the CCFL. Beginning with the assertion of a first measurement interval reset pulse 100-1 in the top line of FIG. 1, then during each of three sequential 'high' amplitude intervals 111-1, 111-2 and 111-3 of the PWM signal 110 following this reset pulse, the contents of a counter/integrator within an analog-to-digital converter are incremented by a prescribed clock signal applied thereto. During each 'low' (or zero) amplitude interval 112-1 and 112-2 of the PWM signal 110, the contents of the integrator remain unchanged. Eventually, at the end of the measurement interval, which is just prior to the second measurement interval reset pulse 100-2, the counter/integrator output will be at some value 121. For the illustrated example, this value is based upon the sequential incrementing of a counter during the three 'high' amplitude pulses 111-1, 111-2 and 111-3. Upon the assertion of the second measurement interval reset pulse 100-2, the value 121 of the integrator/counter is latched in light output monitoring and control circuitry for the next measurement interval, and the contents of the integrator/counter are then cleared.

Then, beginning with the assertion of the next succeeding measurement interval reset signal 100-2, during each of two 'high' amplitude interval 111-4 and 111-5 of the PWM signal 110, the contents 120 of the counter/integrator are sequentially incremented—eventually reaching a value 122, just prior to the next reset pulse 100-3. As can be seen from FIG. 1, because only two 'high' amplitude intervals are integrated during the integration period between measurement interval reset pulses 100-2 and 100-3, the integration value 122 will be less than the integration value 121. This means that upon assertion of the next reset signal 100-3, the relatively reduced value 122 of the integrator will be latched in the light output monitoring and control circuitry for the next measurement interval.

As will be appreciated from the foregoing description and as can be seen from FIG. 1, because the above described operations are sequentially repeated for successive integration periods, the latched values will alternately change between a relatively higher value 121 and a relatively lower value 122, even though the average value of the input signal 110 itself does not change (in the absence of a change its duty cycle). This alternating of the latched value constitutes the aforementioned unwanted 'flickering' of the average light value output of the lamp.

SUMMARY OF THE INVENTION

In accordance with the present invention, this unwanted 'flickering' noise problem is effectively obviated by synchronizing the times of occurrence of the integration period reset pulses with integral multiples of the period of the PWM input signal, so that the integration periods over which an average of the light value output of the lamp is determined are the same. Pursuant to an exemplary embodiment, the overall architecture of a power supply architecture for powering, controllably adjusting (dimming) and monitoring the brightness of the output of a light source such as a cold cathode fluorescent lamp, comprises a power supply, the output of which is switched on and off at a prescribed switching frequency (e.g., 100 Hz), by a PWM dimming signal generator. The output signal F_LAMP produced by the PWM dimming signal generator is coupled to both the lamp power supply and to a DIVIDE BY N divider. The divider is operative to divide the F_LAMP signal by an integral value N, so as to produce an integration interval reset or synchronization signal (or F_SYNC pulse) having a frequency which is equal to an integral fraction of the frequency of the PWM dimming signal F_LAMP. The F_SYNC pulse is coupled to prescribed control inputs of circuitry within a synchronized integrating analog to digital converter (ADC) unit.

The integrating ADC unit contains an analog light sensor, which monitors the modulated light signal emitted by the CCFL (or other light source) and outputs a voltage that tracks the variations in the light output of the CCFL (or other light source). This ANALOG INPUT signal is coupled to an integrating ADC. During relatively high portions of the ANALOG INPUT signal, the contents of the integrating ADC, which are initially cleared or reset by the F_SYNC output of the DIVIDE BY N divider, are successively incremented by the clock output of a local clock oscillator applied to a CLK input of the ADC. The running count contents COUNT of the ADC are made available at a COUNT output port, which is coupled to an ADC REGISTER.

The F_SYNC pulse output of the DIVIDE BY N divider is also applied to a RESET/START input of an auxiliary counter, which has a clock input CLK thereof coupled to the output of the local clock oscillator, so that the contents of counter will also be incremented by the output of the clock oscillator. The running count contents of this counter are made available to a PERIOD REGISTER. Each of the PERIOD REGISTER and the ADC REGISTER has a respective LATCH input thereof coupled to the F_SYNC output of the DIVIDE BY N divider. This serves to load the running count for an immediately previous count cycle of the integrating ADC into the ADC register, and to load the count of the auxiliary counter into the PERIOD register. These latched values are coupled to an ADC/PERIOD divider, which is operative to divide the ADC register's latched count value by the period register's latched count value to provide an output that is proportional to the average input between each sync pulse F_SYNC and is independent of F_LAMP.

In operation, in response to being controllably switched ON and OFF by the PWM dimming signal F_LAMP generated by the PWM dimming signal generator, the CCFL (or other light source) power supply supplies a PWM-based energization signal to the CCFL (or other light source). The light sensor detects the PWM modulation of the optical signal as produced by the ON/OFF powering of the lamp by the power supply, and outputs an analog input signal that is supplied to the integrating ADC. Similar to the waveform diagram of FIG. 1, described above, beginning with a first synchronization signal, for successive intervals during which the input signal has a relatively high (non-zero) voltage level, the originally cleared contents of the integrating ADC will be sequentially incremented at the frequency of clock oscillator during the relatively high portions of the ANALOG INPUT signal, so as to incrementally ramp up the count contents of the integrating ADC.

As a result of this sequential incrementing, the COUNT value contents of the ADC eventually reach a count value just prior to the occurrence of the next sync pulse F_SYNC produced by the DIVIDE BY N divider, which terminates the first integration interval and starts the second integration interval. In response to this next F_SYNC pulse, the count contents of the ADC COUNT port are transferred into the ADC register which stores the latched count value for the next integration interval. In addition to causing the count value contents of the integrating ADC to be latched in its associated ADC register, the F_SYNC pulse causes the contents of the PERIOD COUNTER, which had been initially reset by the last F_SYNC pulse, to be latched into the PERIOD REGISTER. The divider divides the ADC count value that has been latched into the ADC register by the period count value that has been latched into the PERIOD REGISTER to produce a 'normalized' output value that is proportional to the average input from the analog light sensor and which is independent of the frequency of the PWM signal produced by PWM dimming oscillator.

In response to the next F_SYNC signal 300-2, the above described counter incrementing operations are carried out during successive count incrementing intervals, where the input signal has a relatively high (non-zero) voltage level, with the integrating ADC counting clock signals from the clock signal generator at a frequency established by the relatively high portions of the ANALOG INPUT signal, so as to incrementally ramp up the COUNT port contents of the ADC. As a result of this sequential incrementing, the contents of the ADC's output COUNT port will again eventually reach a prescribed value just prior to the occurrence of the next F_SYNC pulse produced by the DIVIDE BY N divider, which terminates the second integration interval and starts the third integration interval.

In response to the next F_SYNC pulse, the accumulated contents of the ADC are transferred into the ADC register, which stores the counter value for the next integration interval. In addition to causing the incremented contents of the integrating ADC to be latched into the ADC register, the F_SYNC pulse causes the contents of the auxiliary counter, which had been initially reset by the last F_SYNC pulse, to be latched into the PERIOD REGISTER. The divider again divides the count value that has been latched into the ADC register by the count value that has been latched into the PERIOD REGISTER to produce a value that is proportional to the average input from the analog light sensor.

The above-described process is sequentially repeated for each successive integration interval. In the absence of a change in the duty cycle of the PWM dimming signal F_LAMP, and with the F_SYNC signals being synchronized with the PWM input signals, the respective values stored in ADC register and PERIOD REGISTER will be repeatedly the same, so that there is no 'flickering' noise problem as occurs with a non-synchronized methodology, as described above.

By comparing the ADC COUNT/PERIOD COUNT ratio produced by the divider with a desired light output from the CCFL (or other light source), it may be determined whether an adjustment by the PWM dimming oscillator needs to be made. Where the lamp brightness is controlled by an adjustable control voltage, the output of the divider may be coupled to one input of a difference amplifier within the duty cycle control unit, a second input of which receives the brightness control voltage. The output of the difference amplifier which sets the duty cycle of the PWM dimming signal may then be coupled to the PWM oscillator, so as to provide a servo loop adjustment of the duty cycle of the PWM dimming signal in accordance with the brightness control voltage, and drive the difference between the control voltage and the output of the divider to zero.

DETAILED DESCRIPTION

Before detailing the architecture and operation of the digitally synchronized integrator of the present invention, it should be observed that the invention resides primarily in a prescribed novel arrangement of conventional controlled power supply and digital switching circuits and components therefor. Consequently, the configuration of such circuits and components and the manner in which they may be interfaced with a powered utility device, such as a cold cathode fluorescent lamp, have, for the most part, been depicted in FIG. 2 of the drawings by a readily understandable schematic-block diagram, and an associated waveform diagram of FIG. 3, which show only those specific features that are pertinent to the present invention, so as not to obscure the disclosure with details which will be readily apparent to those skilled in the art having the benefit of the description herein. Thus, the diagrammatic illustration of FIG. 2 is primarily intended to show the major components of the invention in a convenient functional grouping, whereby the present invention may be more readily understood.

Figure 2:
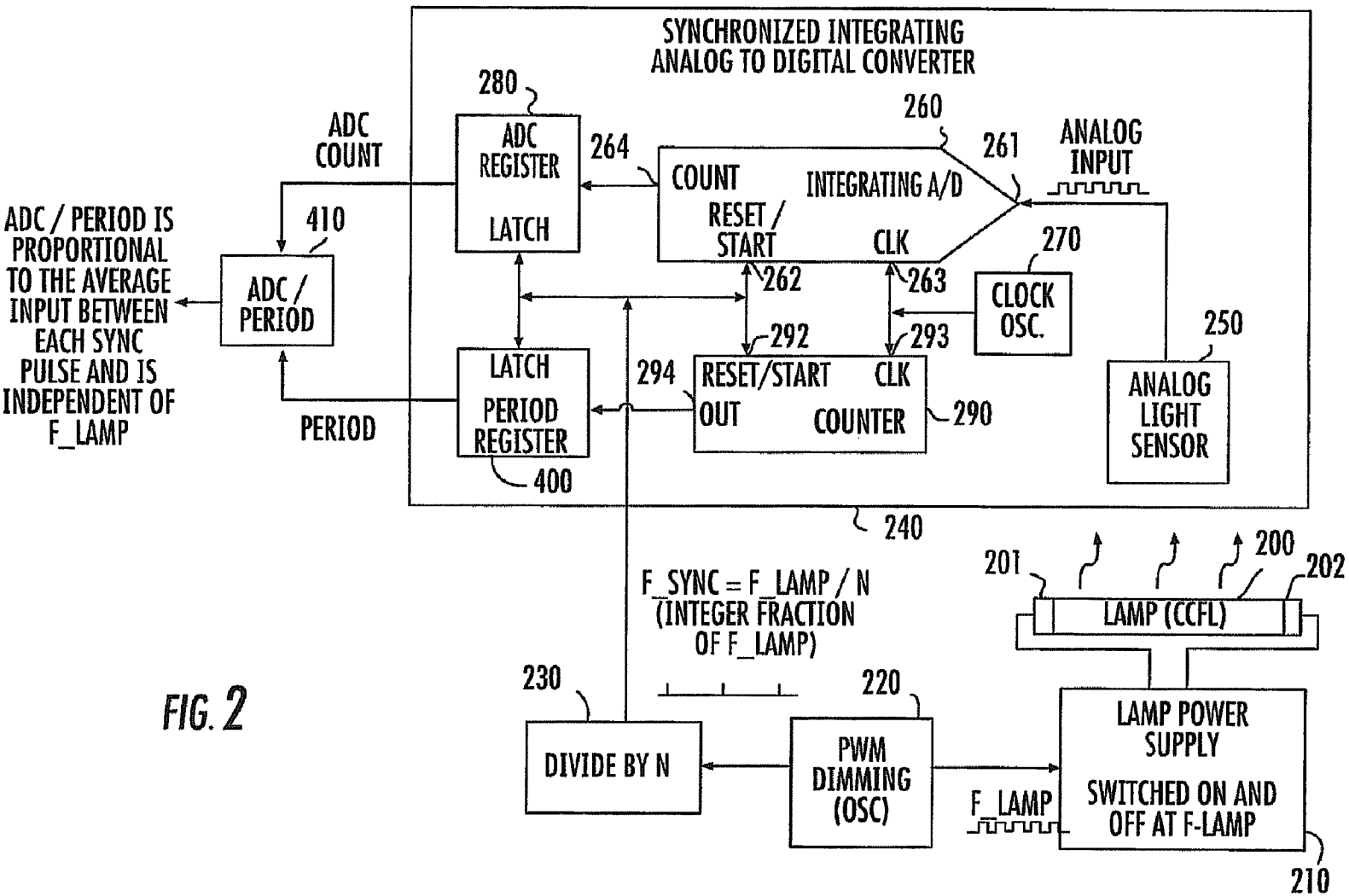
FIG. 2 is a schematic-block diagram of the general architecture of a power supply architecture for powering, controllably adjusting (dimming) and monitoring the brightness of the output of a cold cathode fluorescent lamp, in accordance with a preferred embodiment of the present invention.

Attention is now directed to FIG. 2, which is a schematic-block diagram of the general architecture of a power supply architecture for powering, controllably adjusting (dimming) and monitoring the brightness of the output of a cold cathode fluorescent lamp, in accordance with a preferred embodiment of the present invention. As shown therein, a CCFL 200 has opposite terminals 201 and 202 thereof coupled to receive a switched illumination voltage supplied from a lamp power supply 210. This illumination voltage is switched on and off at a prescribed switching frequency (e.g., 100 Hz), by a PWM dimming signal F_LAMP output by a PWM dimming signal generator 220 that drives the lamp power supply 210, as well as a DIVIDE BY N divider 230. Divider 230 is operative to divide the F_LAMP signal by an integral value N so as to produce an integration interval reset or synchronization signal F_SYNC having a frequency which is equal to an integral fraction of the frequency of the PWM dimming signal F_LAMP. The sync F_SYNC is coupled to prescribed control inputs of circuitry within a synchronized integrating analog to digital converter (ADC) unit 240, as will be described.

ADC unit 240 contains an analog light sensor 250, which is operative to monitor the modulated light signal emitted by CCFL 200 and outputs an AC voltage that tracks the F_LAMP signal variations in the light output of the CCFL 200. This AC voltage ANALOG INPUT is coupled to the input 261 of an integrating ADC 260. During high portions of the ANALOG INPUT signal supplied to its input 261, the contents of ADC 260, which are initially cleared or reset by the output of the DIVIDE BY N divider 230 being applied to a RESET/START input 262, are successively incremented by the clock output of a local clock oscillator 270 applied to a CLK input 263 of the ADC 260. The running count contents COUNT of ADC 260 are made available at a count output port 264, which is coupled to an ADC REGISTER 280.

The output of the DIVIDE BY N divider 230 is also applied to a RESET/START input 292 of an auxiliary counter 290, which has a clock input CLK 293 thereof coupled to the output of the local clock oscillator 270, so that the contents of counter 290 will also be incremented by the output of the clock oscillator 270. The running count contents of counter 290 are made available at a count port OUT 294, which is coupled to a PERIOD REGISTER 400. Each of PERIOD REGISTER 400 and ADC REGISTER 280 has a respective LATCH input thereof coupled to the output of the DIVIDE BY N divider. This serves to load the running count for an immediately previous count cycle of integrating ADC 260 into ADC register 280, and the count of counter 290 into the PERIOD register 400. These latched values are made available to an ADC/PERIOD divider 410, which is operative to divide the ADC register's latched count value by the period register's latched count value to provide an output that is proportional to the average input between each sync pulse F_SYNC and is independent of F_LAMP.

The operation of the architecture of FIG. 2 may be readily understood with reference to the waveform diagrams of FIG. 3, which will now be described. In response to being controllably switched ON and OFF by the PWM dimming signal F_LAMP generated by the PWM dimming signal generator, the CCFL power supply 210 supplies a PWM-based lamp energization AC signal to the CCFL 200. Analog light sensor 250 detects the PWM modulation of the optical signal as produced by the ON/OFF powering of the lamp by the power supply 210, and outputs an analog input signal that is supplied to the input 261 of integrating ADC 260.

Figure 1:
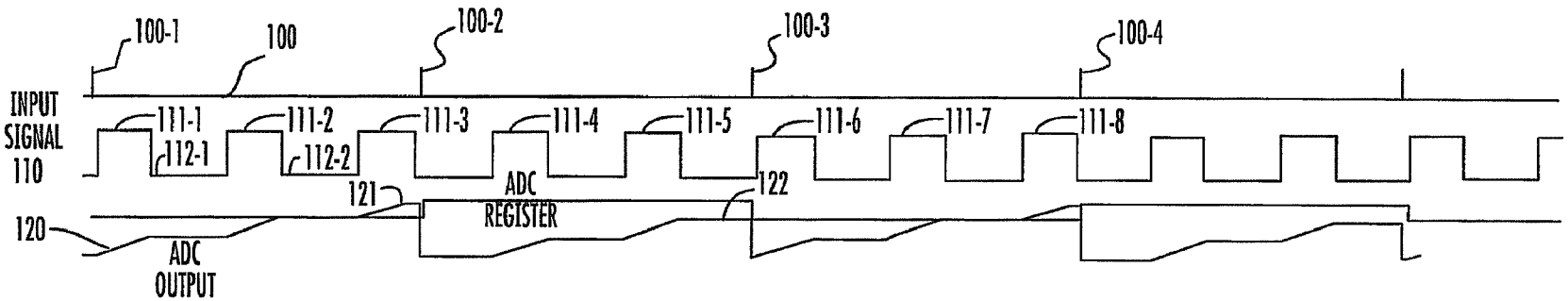
FIG. 1 is a waveform diagram of a fixed duty cycle PWM signal as may be produced from the output of an optical sensor monitoring the modulation of the light output of a CCFL.
Figure 3:
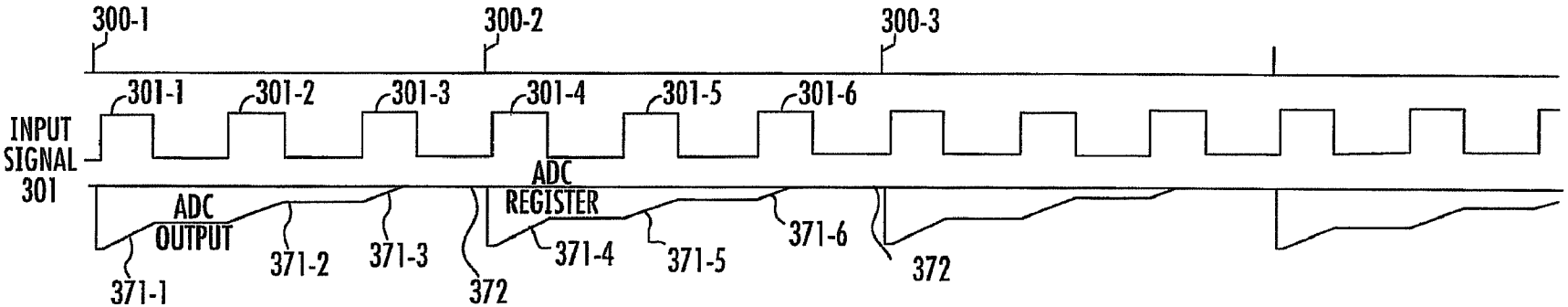
FIG. 3 is a waveform diagram associated with the operation of the power supply architecture of FIG. 2.

This analog input signal is shown at 301 in the timing diagram of FIG. 3. As in the case of the waveform diagram of FIG. 1, described above, beginning with the first synchronization signal 300-1, for the intervals 301-1, 301-2 and 301-3 during which the input signal has a relatively high (non-zero) voltage level, the originally cleared contents of integrating ADC 260 will be sequentially incremented at the frequency of clock oscillator 270 during the relatively high portions 301 of the ANALOG INPUT signal, so as to incrementally ramp up the count contents of the ADC 260, as shown at ramp segments 371-1, 371-2 and 371-3.

As a result of this sequential incrementing, the COUNT value contents of the ADC 260 eventually reach a count value 372 just prior to the occurrence of the next sync pulse (F_SYNC) 300-2 produced by DIVIDE BY N divider 230, which terminates the first integration interval and starts the second integration interval. In response to this next F_SYNC pulse 300-2, the count contents of the ADC 260 COUNT port 264 are transferred into ADC register 280, which stores the latched count value 372 for the next integration interval.

In addition to causing the count value contents of ADC 260 to be latched in ADC register 280, F_SYNC pulse 300-2 causes the contents of the period counter 290, which had been initially reset by F_SYNC pulse 300-1, to be latched in PERIOD REGISTER 400. Divider 410 divides the ADC count value that has been latched into the ADC register 280 by the period count value that has been latched into the PERIOD REGISTER 400 to produce a 'normalized' output value that is proportional to the average input from the analog light sensor 250 and which is independent of the frequency of the PWM signal produced by PWM dimming oscillator 220.

Next, in response to the second F_SYNC signal 300-2, the above described counter incrementing operations are carried out during the intervals 301-4, 301-5 and 301-6, where the input signal has a relatively high (non-zero) voltage level, with ADC 260 counting clock signals from clock signal generator 270 at a frequency established by the relatively high portions 301 of the ANALOG INPUT signal, to incrementally ramp up the COUNT port contents of the ADC 260, as shown at ramp segments 371-4, 371-5 and 371-6. As a result of this sequential incrementing, the contents of the ADC's output COUNT port 264 will again eventually reach a value of 372 just prior to the occurrence of F_SYNC pulse 300-3 produced by DIVIDE BY N divider 230, which terminates the second integration interval and starts the third integration interval.

In response to this next F_SYNC pulse 300-3, the accumulated contents of ADC 260 are transferred into ADC register 280, which stores the counter value 372 for the next integration interval. In addition to causing the incremented contents of ADC 260 to be latched in ADC register 280, the F_SYNC pulse 300-3 causes the contents of the counter 290, which had been initially reset by F_SYNC pulse 300-2, to be latched in PERIOD REGISTER 400. Divider 410 again divides the count value that has been latched into the ADC register 280 by the count value that has been latched into the PERIOD REGISTER 400 to produce a value that is proportional to the average input from the analog light sensor 250.

The above-described process is sequentially repeated for each successive integration interval. In the absence of a change in the duty cycle of the PWM dimming signal F_LAMP, and with the F_SYNC signals 300-1, 300-2, 300-3, . . . , **300-*n* being synchronized with the PWM input signals, the respective values stored in ADC register 280 and PERIOD REGISTER 400** will be repeatedly the same, so that there is no 'flickering' noise problem as occurs with a non-synchronized methodology, as described above.

Figure 4:
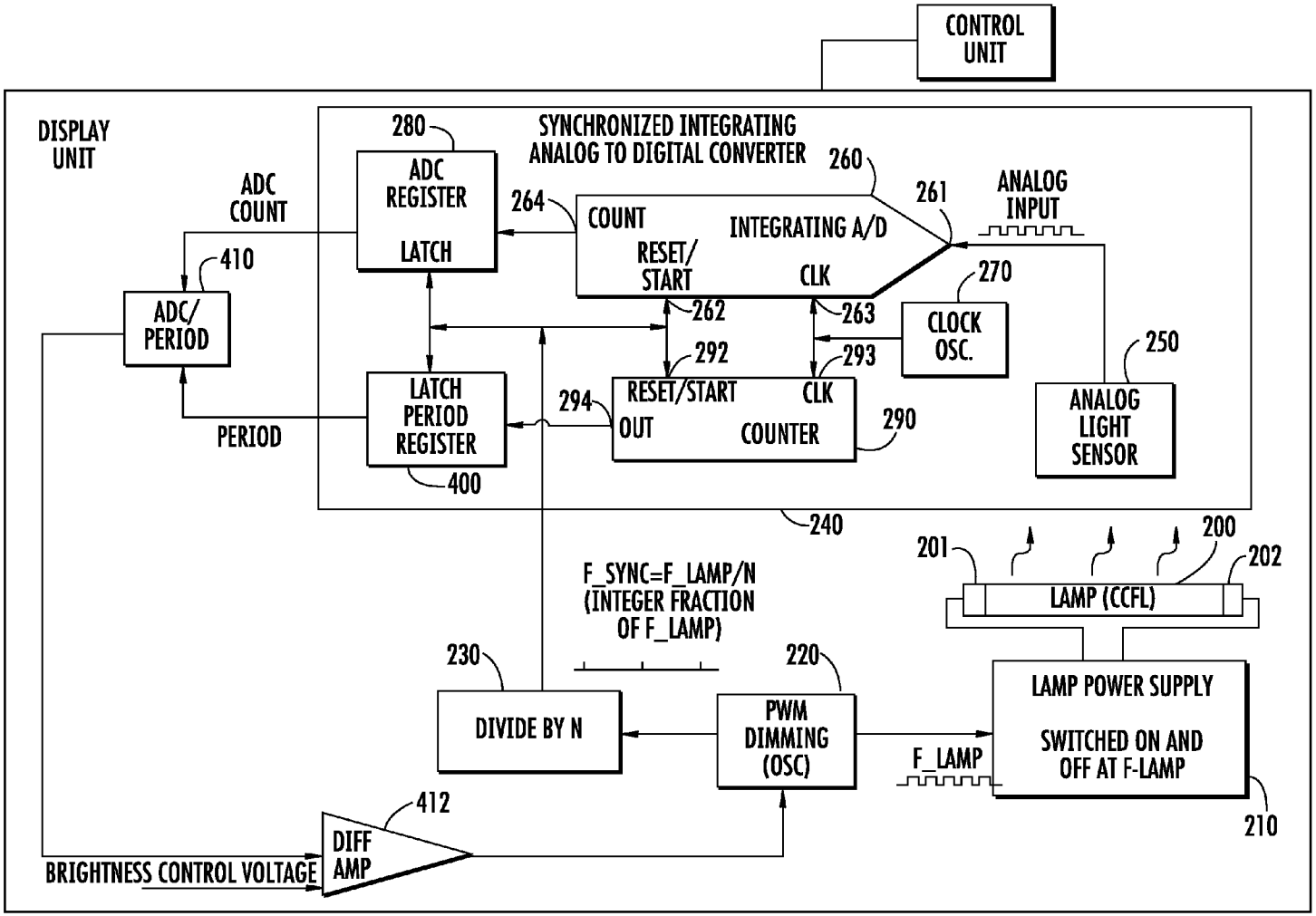
FIG. 4 is a schematic-block diagram of the general architecture of a power supply architecture for powering, controllably adjusting (dimming) and monitoring the brightness of the output of a cold cathode fluorescent lamp, in accordance with one embodiment of the present invention.

By comparing the ADC COUNT/PERIOD COUNT ratio produced by divider 410 with a desired light output from the CCFL 200, a determination can be made as to whether an adjustment by the PWM dimming oscillator 220 needs to be made. Where the lamp brightness is controlled by an adjustable control voltage as shown in FIG. 4, the output of the divider 410 may be coupled to one input of a difference amplifier 412 within the duty cycle control unit, a second input of which receives the brightness control voltage. The output of the difference amplifier 412 which sets the duty cycle of the PWM dimming signal may then be coupled to the PWM oscillator 220, so as to provide a servo loop adjustment of the duty cycle of the PWM dimming signal in accordance with the brightness control voltage, and drive the difference between the control voltage and the output of the divider to zero.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. A system comprising:

a pulse width modulation (PWM) signal generator operable to generate a PWM signal;

a utility device coupled to the PWM signal generator, wherein an output of said utility device is controlled by a duty cycle of the PWM signal; and an analog-to-digital converter (ADC) unit operable to produce an output representative of an average of said output of said utility device, the ADC unit comprising:

a sensor which is operative to monitor said output of said utility device to derive an output signal representative of said PWM signal applied thereto; and an integrating ADC coupled to said sensor, count contents of the integrating ADC being controllably incremented during prescribed pulse width portions of said derived output signal, wherein the operation of said ADC is synchronized with an integral multiple of a period of said PWM signal.

2. The system of claim 1, wherein said utility device comprises one of a cold cathode fluorescent lamp (CCFL), an external electrode fluorescent lamp (EEFL), a light emitting diode (LED), and another light source.

3. The system of claim 1, wherein said ADC unit further comprises an auxiliary counter, contents of which are controllably incremented during a prescribed integration interval, and further comprising a divider which is coupled to receive count values produced by said ADC and said auxiliary counter and to generate a value representative of a ratio of the contents of said ADC and said auxiliary counter as incremented over said prescribed integration interval, to provide a normalized value of the output of said utility device.

4. The system of claim 3, further comprising:

a differential amplifier operable to compare normalized value of the output of said utility device provided by the divider with a brightness control voltage;

wherein an output of the differential amplifier is coupled to the PWM generator to adjust the duty cycle of the PWM signal based on the comparison of the normalized value with the brightness control voltage.

5. A system comprising:

a display unit operable to produce images; and a control unit coupled to the display unit to control the images produced by the display unit;

wherein the display unit comprises:

a light source to emit light used in producing the images;

a pulse width modulation (PWM) signal generator coupled to the light source and operable to generate a PWM signal, wherein the light emitted by the light source is controlled by a duty cycle of the PWM signal; and an analog-to-digital converter (ADC) unit operable to produce an output representative of an average of the light emitted by the light source, the ADC unit comprising:

a sensor operable to monitor the light emitted by the light source to derive a signal representative of the PWM signal applied to the light source; and an integrating ADC coupled to the sensor, wherein count contents of the integrating ADC are controllably incremented during prescribed pulse width portions of the derived signal, wherein the operation of the integrating ADC is synchronized with an integral multiple of a period of the PWM signal.

6. The system of claim 5, wherein the light source is one of a cold cathode fluorescent lamp (CCFL), an external electrode fluorescent lamp (EEFL), and a light emitting diode (LED).

7. The system of claim 5, wherein the ADC unit further comprises:

an auxiliary counter, contents of which are controllably incremented during a prescribed integration interval; and a divider coupled to receive count values produced by the ADC and the auxiliary counter, the divider operable to generate a value representative of a ratio of the contents of the ADC and the contents of the auxiliary counter to provide a normalized value of the light emitted by the light source.

8. The system of claim 7, wherein the display unit further comprises:

a differential amplifier coupled to the divider and operable to compare the normalized value of the light emitted by the light source with a brightness control voltage;

wherein an output of the differential amplifier is coupled to the PWM signal generator to adjust the duty cycle of the PWM signal based on the comparison of the normalized value with the brightness control voltage.

* * * * *